US009274503B2

(12) United States Patent
Ishida et al.

(10) Patent No.: US 9,274,503 B2
(45) Date of Patent: Mar. 1, 2016

(54) SOUND ABSORBER AND IMAGE FORMING APPARATUS INCORPORATING SAME

(71) Applicants: Masahiro Ishida, Kanagawa (JP); Toshihiro Shimada, Tokyo (JP); Naoki Matsuda, Kanagawa (JP)

(72) Inventors: Masahiro Ishida, Kanagawa (JP); Toshihiro Shimada, Tokyo (JP); Naoki Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/514,559

(22) Filed: Oct. 15, 2014

(65) Prior Publication Data

US 2015/0110517 A1 Apr. 23, 2015

(30) Foreign Application Priority Data

Oct. 23, 2013 (JP) ..... 2013-219861

(51) Int. Cl.
*G03G 15/20* (2006.01)
*G03G 21/20* (2006.01)

(52) U.S. Cl.
CPC ..... *G03G 21/206* (2013.01)

(58) Field of Classification Search
CPC ..... G10K 11/172; G03G 21/1604
See application file for complete search history.

(56) References Cited

U.S. PATENT DOCUMENTS 7,136,605 B2 * 11/2006 Tsunoda et al. ..... 399/91
2010/0171022 A1 * 7/2010 Fujimaki et al. ..... 248/559

FOREIGN PATENT DOCUMENTS

JP 10-042085 2/1998
JP 2000-077858 3/2000
JP 2000235396 A * 8/2000
JP 2011-199824 10/2011

OTHER PUBLICATIONS

Machine Translation of JP 2000-235396 A obtained on Mar. 31, 2015.*

* cited by examiner

*Primary Examiner* — Gregory H Curran
(74) *Attorney, Agent, or Firm* — Harness, Dickey & Pierce, P.L.C.

(57) ABSTRACT

A sound absorber includes a duct member constituting a resonance pathway, the duct member including a pathway portion communicating ends of the duct member; a base member including a concave portion; and a cover member including a neck in which to insert the duct member. The cover member covers the concave portion of the base member, and the cover member combined with the base member forms a resonance space having a volume V. The resonance pathway has dimensions of a length LH and a cross-sectional area SH and communicates the resonance space and an exterior of the sound absorber. The sound absorber has a resonance frequency fH determined by $fH=(c/2\pi)\cdot(SH/V\cdot LH)^{1/2}$ and absorbs sound having the resonance frequency fH, where c represents sound velocity.

15 Claims, 4 Drawing Sheets

SOUND ABSORBER AND IMAGE FORMING APPARATUS INCORPORATING SAME

CROSS-REFERENCE TO RELATED APPLICATION

This patent application is based on and claims priority pursuant to 35 U.S.C. §119 from Japanese Patent Application No. 2013-219861, filed on Oct. 23, 2013 in the Japan Patent Office, which is hereby incorporated by reference herein in its entirety.

BACKGROUND

1. Technical Field

Exemplary embodiments of the present disclosure generally relate to a sound absorber that absorbs a sound of a specific frequency range and an image forming apparatus including the sound absorber.

2. Description of the Related Art

Image forming apparatuses such as copiers, plain-sheet facsimile machines, and laser printers include a drive source such as a motor or a drive mechanism driven by a motor. Accordingly, noise is generated when operating the image forming apparatus. Sources of noise include, for example, rotation of a polygon mirror and driving of the drive mechanism.

Conventional silencing technologies are proposed, in which, to suppress noise having a specific frequency, a technology employing a Helmholtz resonator as a sound absorber is provided.

However, with conventional silencing technologies employing a Helmholtz resonator as a sound absorber, the sound frequency that is absorbed is fixed. Thus, to change the sound frequency that is absorbed, it is necessary to replace the sound absorber with another sound absorber having different specifications or change primary parts constituting the sound absorber. Accordingly, a problem of cost increase arises.

SUMMARY

In view of the foregoing, in an aspect of this disclosure, there is provided a novel sound absorber including a duct member constituting a resonance pathway, the duct member including a pathway portion communicating ends of the duct member; a base member including a concave portion; and a cover member including a neck in which to insert the duct member. The cover member covers the concave portion of the base member, and the cover member combined with the base member forms a resonance space having a volume V. The resonance pathway has dimensions of a length LH and a cross-sectional area SH and communicates the resonance space and an exterior of the sound absorber. The sound absorber has a resonance frequency fH determined by $fH=(c/2\pi)\cdot(SH/(V\cdot LH))^{1/2}$ and absorbs sound having the resonance frequency fH, where c represents sound velocity.

In an aspect of this disclosure, there is provided a novel image forming apparatus including an image forming section and the sound absorber. The image forming section forms an image on a recording medium. The sound absorber absorbs sound generated when the image forming section forms the image.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
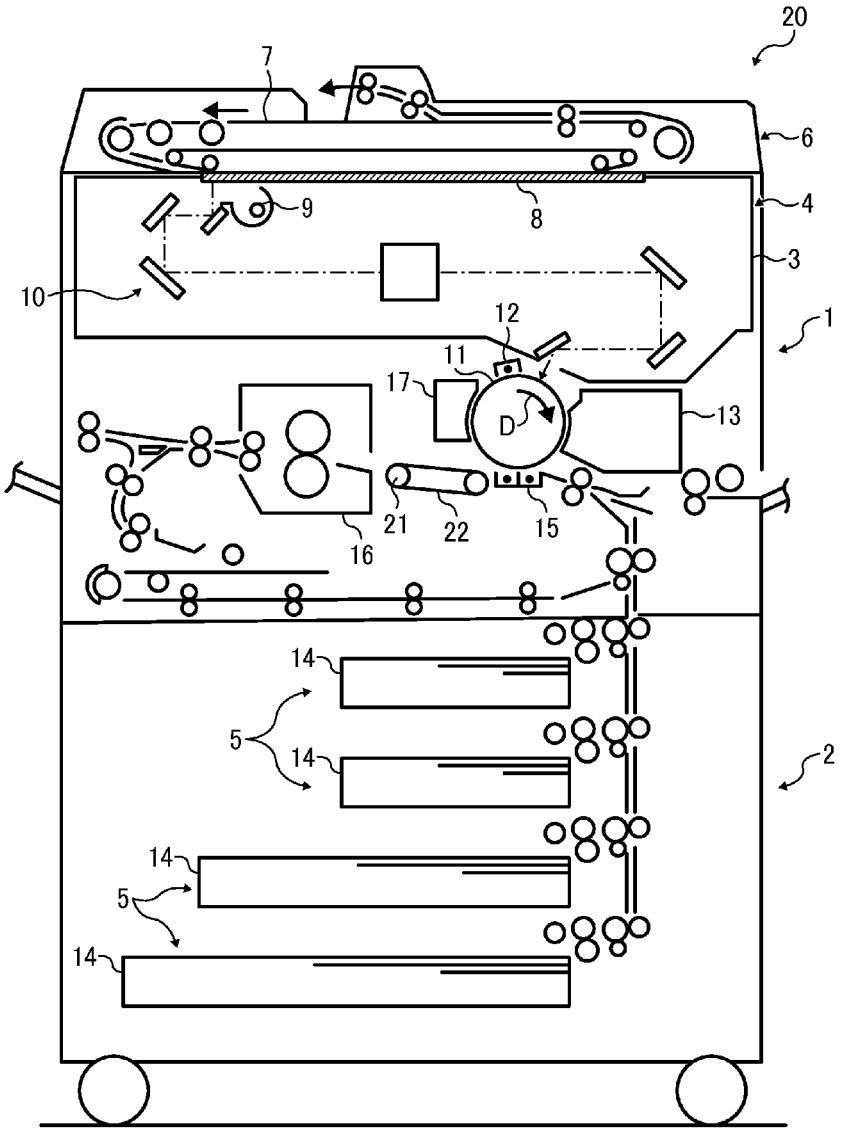
FIG. 1 is a schematic view of an example of an image forming apparatus including a sound absorber according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but may be modified and improved within the scope of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

There is provided a novel sound absorber in which a sound frequency that is absorbed may be easily changed at low cost, and an image forming apparatus including the sound absorber. The following is a description of the sound absorber according to an embodiment of the present invention and the image forming apparatus including the sound absorber.

The sound absorber according to an embodiment of the present invention has the following features. The sound absorber includes a resonance space having a volume V, and a resonance pathway having dimensions of a length LH and a cross-sectional area SH that communicates the resonance space with the exterior of the sound absorber. The sound absorber has a predetermined resonance frequency fH and absorbs a sound having that predetermined resonance frequency fH. The sound absorber is formed of a duct member constituting the resonance pathway, a base member including a concave portion, and a cover member including a neck in which to insert the duct member. The cover member covers the concave portion of the base member, and the cover member combined with the base member forms the resonance space.

The duct member may be replaced with a duct member having at least one of length LH and cross-sectional area SH changed to a desired size.

An example of the image forming apparatus including the sound absorber according to an embodiment of the present invention is as follows.

FIG. 1 is a schematic view of an example of an image forming apparatus 20 including the sound absorber according to an embodiment of the present invention. In the present embodiment, the image forming apparatus 20 is a copier. The image forming apparatus 20 is generally called a console-type copier and has a high overall height so the image forming apparatus 20 may be used set on the floor. The image forming apparatus 20 is formed of an upper part 1 and a lower part 2. The upper part 1 is an image forming section including an optical unit 4 having optical elements inside a case 3, and units for image formation provided below the optical unit 4. The optical elements may include a rotationally driven polygon mirror to scan a light beam that irradiates a photoreceptor. The lower part 2 includes multiple trays 5. An automatic document feeder 6 (hereinafter referred to as ADF 6) is mounted on top of the upper part 1.

When a document is placed on a document table 7 provided at an upper portion of the ADF 6, the document is automatically conveyed to and stops on a exposure glass 8 supported by the case 3 of the optical unit 4. Next, a light source 9 of the optical unit 4 at a position shown in FIG. 1 moves in a direction to the right. A surface of the document facing the exposure glass 8 is illuminated by the light source 9, and an electrostatic latent image of the illuminated surface of the document is formed on a photoreceptor fH via an image forming optical system 10 inside the optical unit 4.

It is to be noted that the photoreceptor 11 rotates in a clockwise direction as shown by arrow D in FIG. 1 and the surface of the photoreceptor 11 is uniformly charged by a charger 12 when rotating. The electrostatic latent image is formed on the uniformly charged surface of the photoreceptor 11 with the above-described image forming optical system 10.

Then, the electrostatic latent image on the photoreceptor 11 is rendered visible as a toner image with toner supplied from a developing unit 13.

At the lower part 2, a transfer sheet 14 serving as a recording medium is conveyed to the photoreceptor 11 from one of the trays 5 provided in the lower part 2. The toner image on the photoreceptor 11 is transferred to the transfer sheet 14 with a transfer charger 15. The toner image is fixed to the transfer sheet 14 when the transfer sheet 14 having the toner image passes through a fixing unit 16. Then, the transfer sheet 14 is ejected from the image forming apparatus as a completed copy. It is to be noted that the image forming apparatus 20 shown in FIG. 1 has a configuration in which duplex copying may be conducted, however, description with respect to such is omitted herein for brevity.

After transfer of the toner image to the transfer sheet 14, residual toner on the photoreceptor 11 is removed by a cleaning unit 17.

As described above, the image forming apparatus 20 shown in FIG. 1 includes various parts and units, and driven members are driven by a driving force of one or more motors. Further, the above-described various parts and units are supported by a structural skeleton.

A Helmholtz resonator as a sound absorber according to an embodiment of the present invention is provided in the image forming apparatus 20. The following is a description of embodiments of the sound absorber according to an embodiment of the present invention.

Embodiment 1

Figure 2:
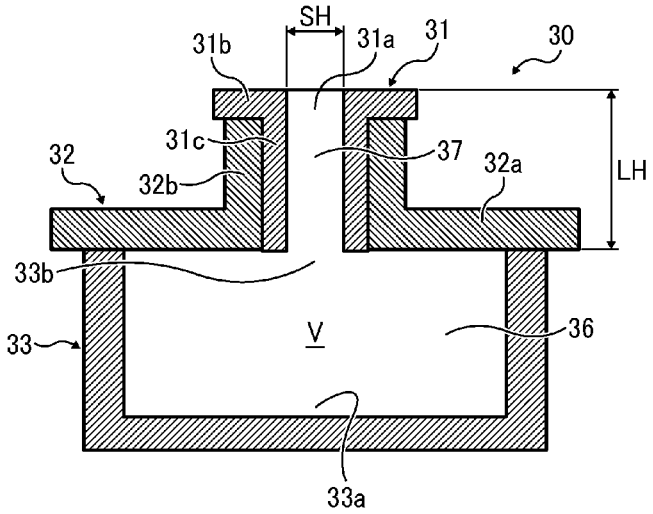
FIG. 2 is a cross-sectional view of a sound absorber according to a first embodiment of the present invention.

FIG. 2 is a cross-sectional view of a sound absorber 30 of a first embodiment of the present invention. The sound absorber 30 forming a Helmholtz resonator includes a resonance space 36 having a volume V, and a resonance pathway 37 having dimensions of a length LH and a cross-sectional area SH that communicates the resonance space 36 with the exterior of the sound absorber 30.

The Helmholtz resonator has a resonance frequency fH determined by the following formula 1:

$$fH=(c/2\pi)\cdot(SH/(V\cdot LH))^{1/2} \quad (1)$$

Accordingly, the Helmholtz resonator operating as the sound absorber 30 absorbs a sound having the resonance frequency fH. In formula 1, "c" represents sound velocity. At the resonance frequency fH, the Helmholtz resonator traps acoustic energy going to the resonance space 36 and a silenced state is obtained outside of the Helmholtz resonator (i.e., inside of an image forming apparatus). More specifically, sound having the resonance frequency fH is trapped by the Helmholtz resonator. Accordingly, the resonance frequency fH does not escape out of the image forming apparatus and a silencing effect is obtained.

The sound absorber 30 is formed of three members, a duct member 31, a cover member 32, and a base member 33. The duct member 31, the cover member 32, and the base member 33 are molded members made of a synthetic resin and are easily manufactured at low cost.

The duct member 31 includes a circular disk-shaped flange portion 31*b*, a cylinder-shaped tube portion 31*c*, and a pathway portion 31*a* operating as the resonance pathway 37 that communicates ends of the duct member 31.

The cover member 32 includes a flat plate-shaped lid portion 32*a*, and a cylindrical neck 32*b* formed in the flat plate-shaped lid portion 32*a*. The duct member 31 is inserted in the cylindrical neck 32*b*. More specifically, when the duct member 31 is inserted in the cylindrical neck 32*b* of the cover member 32, the circular disk-shaped flange portion 31*b* of the duct member 31 contacts a rim of the cylindrical neck 32*b* of the cover member 32, and the duct member 31 is mounted in place.

The base member 33 includes a concave portion 33*a* defining the resonance space 36. More specifically, the resonance space 36 is formed by combining the base member 33 with the cover member 32 in a manner in which an opening portion 33*b* of the concave portion 33*a* of the base member 33 is covered with the flat plate-shaped lid portion 32*a* of the cover member 32. It is to be noted that as long as the resonance space 36 has the predetermined volume V, shape of the resonance space 36 formed by the base member 33 and the cover member 32 may be changed according to need. For example, the shape of the resonance space 36 may be a cuboid, a cube, a sphere, or any arbitrary shape that may be set between various image forming devices provided in an image forming apparatus.

In the sound absorber 30, a specific frequency range is selected as the resonance frequency fH. More specifically, the specific frequency range selected as the resonance frequency fH may be a frequency of a sound generated by a polygon mirror, or may be a frequency of a sound generated by a driving device, such as a conveyance mechanism 22 in the image forming section of the image forming apparatus 20, including a motor and a driven member, such as a conveyance drive roller 21, driven by the motor.

In the sound absorber 30 of the first embodiment, multiple types of the duct member 31 may be prepared, based on the volume V of the resonance space 36 formed by the base member 33 and the cover member 32, depending on the sound frequencies that may be absorbed. Thus, more specifically, multiple types of the pathway portion 31*a* of the duct member 31 are prepared having, based on the volume V of the resonance space 36 formed by the base member 33 and the cover member 32, dimensions of the length LH and the cross-sectional area SH in accordance with the sound frequencies that are to be absorbed.

Each of the above-described multiple types of the duct member 31 has a cylindrical shape with a fixed outer diameter, with at least one of the length LH and the cross-sectional area SH of the pathway portion 31*a* changed. Accordingly, all of the above-described multiple types of the duct member 31 may be inserted into the cylindrical neck 32*b* of the cover member 32.

According to the first embodiment, a desired sound frequency absorption is obtained with respect to image forming apparatuses having a common housing but generating noise of different frequencies by selecting and setting the appropriate duct member 31. Due to not needing to change a large part of the sound absorber 30, absorbed sound frequency may be changed at low cost.

In addition, even in a case in which a sound frequency generated by an image forming apparatus changes after continued use, the changed sound frequency may be cancelled out by changing the duct member 31 to change absorbed sound frequency. Further, absorbed sound frequency may be set according to individual user at low cost. It is to be noted that the shape of the duct member 31 is not limited to a round cylindrical shape and may have other shapes such as a square cylinder.

Embodiment 2

The following is a description of a sound absorber 40 of a second embodiment of the present invention.

Figure 3:
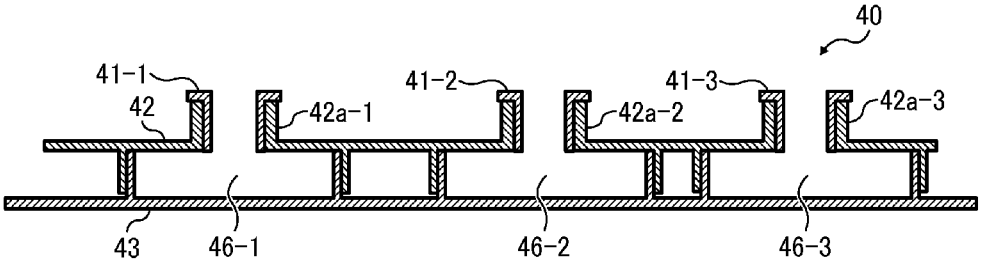
FIG. 3 is a cross-sectional view of a sound absorber according to a second embodiment of the present invention.

FIG. 3 is a cross-sectional view of the sound absorber 40 of the second embodiment of the present invention. The sound absorber 40 of the second embodiment includes a base member 43 and a cover member 42 that forms multiple resonance spaces. As shown in FIG. 3, three resonance spaces 46-1, 46-2, and 46-3 are formed. The cover member 42 of the sound absorber 40 includes three necks 42*a*-1, 42*a*-2, and 42*a*-3. Duct members 41-1, 41-2, and 42-3 are inserted in the three necks 42*a*-1, 42*a*-2, and 42*a*-3, respectively.

In the sound absorber 40 of the second embodiment, appropriate values with respect to volumes V1, V2, and V3 are set for the resonance spaces 46-1, 46-2, and 46-3, respectively. Further, appropriate values with respect to dimensions of a length LH1 and a cross-sectional area SH1, dimensions of a length LH2 and a cross-sectional area SH2, and dimensions of a length LH3 and a cross-sectional area SH3 are set for the duct members 41-1, 41-2, and 41-3, respectively. Accordingly, absorption of three different sound frequency ranges is obtained.

It is to be noted that the sound absorber 40 of the second embodiment takes up a large area. Thus, the base member 43 may be configured as an exterior part of an image forming apparatus, thereby reducing the number of exterior parts of the image forming apparatus.

Embodiment 3

The following is a description of a sound absorber 50 of a third embodiment of the present invention.

Figure 4:
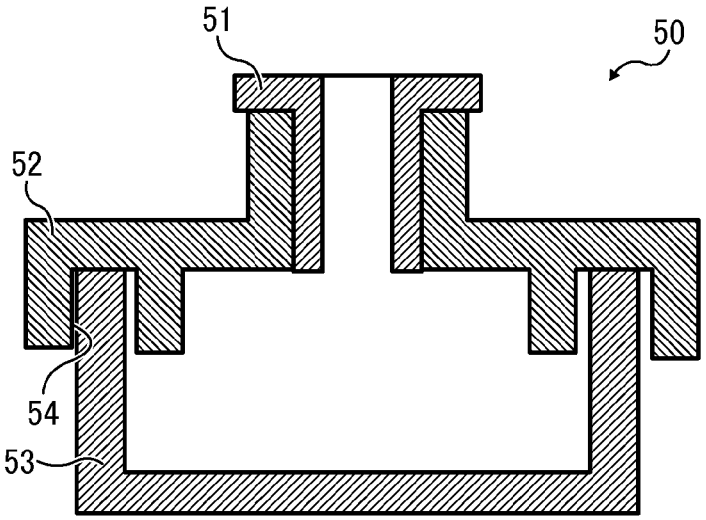
FIG. 4 is a cross-sectional view of a sound absorber according to a third embodiment of the present invention.

FIG. 4 is a cross-sectional view of the sound absorber 50 of the third embodiment of the present invention. The sound absorber 50 of the third embodiment has a configuration that is basically the same as the sound absorber 30 of the first embodiment. More specifically, the sound absorber 50 is formed of a duct member 51, a cover member 52, and a base member 53. In the sound absorber 50, however, a groove-shaped recessed portion 54 is formed in the cover member 52 to accommodate an end portion of the base member 53. In the sound absorber 50 of the third embodiment, the cover member 52 and the base member 53 are reliably mounted in place, and air leakage between the cover member 52 and the base member 53 is securely prevented. Thus, sound absorbing performance is enhanced.

Embodiment 4

The following is a description of a sound absorber 60 of a fourth embodiment of the present invention.

Figure 5:
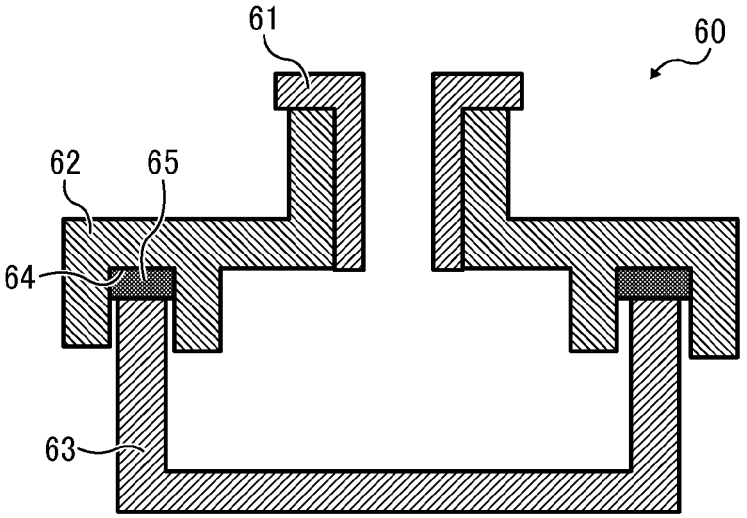
FIG. 5 is a cross-sectional view of a sound absorber according to a fourth embodiment of the present invention.

FIG. 5 is a cross-sectional view of the sound absorber 60 of the fourth embodiment of the present invention. The sound absorber 60 of the fourth embodiment has a configuration that is basically the same as the sound absorber 50 of the third embodiment. More specifically, the sound absorber 60 is formed of a duct member 61, a cover member 62, and a base member 63. In the sound absorber 60, however, a groove-shaped recessed portion 64 is formed in the cover member 62 to accommodate an end portion of the base member 63, and a sealing member 65 is provided in the groove-shaped recessed portion 64, enhancing the seal between the cover member 62 and the base member 63.

With the sound absorber 60 of the fourth embodiment, air leakage between the cover member 62 and the base member 63 is reliably prevented and sound absorbing performance is enhanced.

Embodiment 5

The following is a description of a sound absorber 70 of a fifth embodiment of the present invention.

Figure 6:
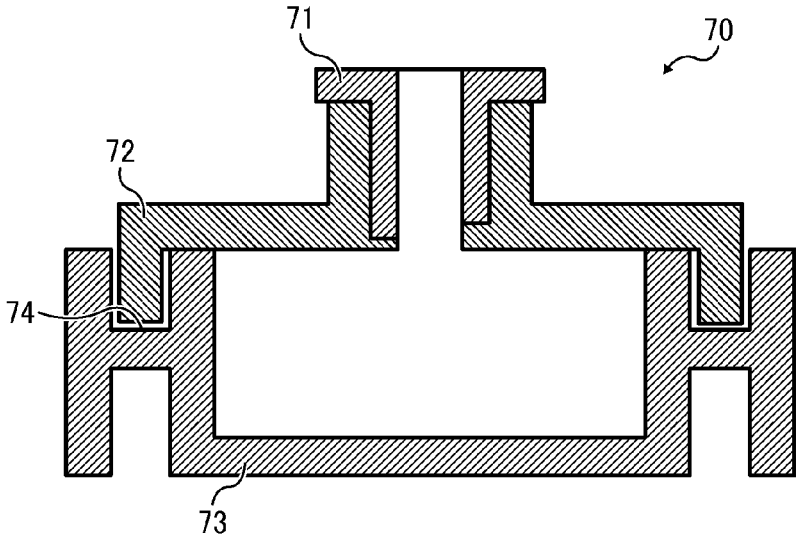
FIG. 6 is a cross-sectional view of a sound absorber according to a fifth embodiment of the present invention.

FIG. 6 is a cross-sectional view of the sound absorber 70 of the fifth embodiment of the present invention. The sound absorber 70 is formed of a duct member 71, a cover member 72, and a base member 73. In the sound absorber 70, a groove-shaped recessed portion 74 is formed in the base member 73 to accommodate an end portion of the cover member 72.

Embodiment 6

The following is a description of a sound absorber 80 of a sixth embodiment of the present invention.

Figure 7:
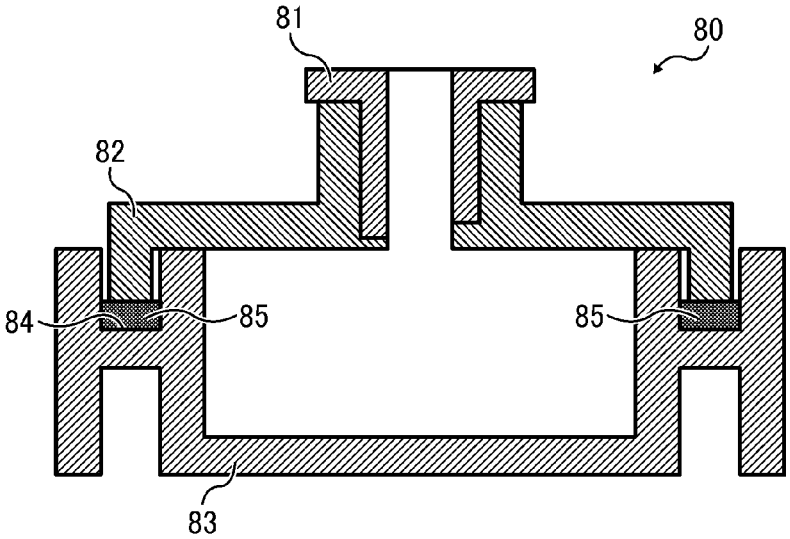
FIG. 7 is a cross-sectional view of a sound absorber according to a sixth embodiment of the present invention.

FIG. 7 is a cross-sectional view of the sound absorber 80 of the sixth embodiment of the present invention. The sound absorber 80 of the sixth embodiment has a configuration that is basically the same as the sound absorber 70 of the fifth embodiment. In the sound absorber 80 of the sixth embodiment, however, a sealing member 85 that enhances air-sealing is provided in a groove-shaped recessed portion 84.

In view of the foregoing, in the sound absorber of the present invention formed as the Helmholtz resonator, the duct member forming a duct part of the Helmholtz resonator may be selected and set to obtain appropriate sound frequency absorption with respect to image forming apparatuses having a common housing but generating noise of different frequencies. Further, absorbed sound frequency may be changed without changing a large part of the sound absorber.

What is claimed is:

1. A sound absorber, comprising:

a duct member constituting a resonance pathway, the duct member including a pathway portion communicating ends of the duct member;

a base member including a concave portion; and a cover member including an insertion neck in which to insert the duct member, wherein the cover member covers the concave portion of the base member, and the cover member combined with the base member forms a resonance space having a volume V, wherein the resonance pathway has dimensions of a length LH and a cross-sectional area SH and communicates the resonance space and an exterior of the sound absorber, and wherein the sound absorber has a resonance frequency fH determined by $fH=(c/2\pi)\cdot(SH/(V\cdot LH))^{1/2}$ and absorbs sound having the resonance frequency fH, where c represents sound velocity, wherein the insertion neck extends above a top surface of the cover member.

2. The sound absorber of claim 1, wherein the duct member is configured to be replaceable with a duct member having a different length LH and/or cross-sectional area SH.

3. The sound absorber of claim 1, wherein the base member and the cover member form a plurality of resonance spaces.

4. The sound absorber of claim 1, comprising multiple types of the duct member, each type having, based on the volume V of the resonance space formed by the base member and the cover member, dimensions of length LH and cross-sectional area SH that vary in accordance with absorbed sound frequency.

5. An image forming apparatus, comprising:

an image forming section to form an image on a recording medium; and the sound absorber of claim 1 to absorb sound generated when the image forming section forms the image.

6. The image forming apparatus of claim 5, wherein the image forming section includes a polygon mirror to scan a light beam irradiating a photoreceptor, and absorbed sound frequency of the sound absorber is a frequency of sound generated by the polygon mirror during operation.

7. The image forming apparatus of claim 5, wherein the image forming section includes a driving device including a motor and a driven member driven by the motor, and absorbed sound frequency of the sound absorber is a frequency of sound generated by the driving device.

8. The image forming apparatus of claim 5, wherein at least one member forming the sound absorber is configured as an exterior part of the image forming apparatus.

9. The sound absorber of claim 1, wherein the duct member includes a discal brim and a cylindrical tube inserted into the insertion neck.

10. The sound absorber of claim 1, wherein the duct member includes a flange that extends above the insertion neck.

11. A sound absorber, comprising:

a duct member constituting a resonance pathway, the duct member including a pathway portion communicating ends of the duct member;

a base member including a concave portion; and a cover member including an insertion neck in which to insert the duct member, wherein the cover member covers the concave portion of the base member, and the cover member combined with the base member forms a resonance space having a volume V, wherein the resonance pathway has dimensions of a length LH and a cross-sectional area SH and communicates the resonance space and an exterior of the sound absorber, and wherein the sound absorber has a resonance frequency fH determined by $fH=(c/2\pi)\cdot(SH/(V\cdot LH))^{1/2}$ and absorbs sound having the resonance frequency fH, where c represents sound velocity, wherein one of the base member and the cover member has a recessed portion into which an end portion of the other of the base member and the cover member is accommodated.

12. The sound absorber of claim 11, further comprising a sealing member provided in the recessed portion.

13. An image forming apparatus, comprising:

the sound absorber of claim 11.

14. The sound absorber of claim 11, wherein the insertion neck extends above a top surface of the cover member.

15. The sound absorber of claim 11, wherein the duct member includes a flange that extends above the insertion neck.

* * * * *